US010991330B1

(12) United States Patent
Li et al.

(10) Patent No.: US 10,991,330 B1
(45) Date of Patent: Apr. 27, 2021

(54) SPLIT-SCREEN DRIVING OF ELECTRONIC DEVICE DISPLAYS

(71) Applicant: Apple Inc., Cupertino, CA (US)

(72) Inventors: Jun Li, San Jose, CA (US); Hopil Bae, Sunnyvale, CA (US); Chaohao Wang, Sunnyvale, CA (US); Yue Chu, San Jose, CA (US); Anshi Liang, San Jose, CA (US); Ming Xu, Cupertino, CA (US); Xiaokai Li, Sunnyvale, CA (US); Yang Xu, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/428,663

(22) Filed: May 31, 2019

Related U.S. Application Data

(60) Provisional application No. 62/694,915, filed on Jul. 6, 2018.

(51) Int. Cl.

| | |
|---|---|
| ***G09G 3/36*** | (2006.01) |
| ***G09G 3/3266*** | (2016.01) |
| ***G09G 1/00*** | (2006.01) |

(52) U.S. Cl.
CPC ..... *G09G 3/3674* (2013.01); *G09G 1/007* (2013.01); *G09G 3/3266* (2013.01); *G09G 3/3677* (2013.01); *G09G 2310/021* (2013.01); *G09G 2310/0202* (2013.01); *G09G 2310/0205* (2013.01); *G09G 2310/0213* (2013.01); *G09G 2310/0267* (2013.01); *G09G 2310/0283* (2013.01)

(58) Field of Classification Search
CPC .. G09G 3/3266; G09G 3/3674; G09G 3/3677; G09G 2310/0202; G09G 2310/0205; G09G 2310/021; G09G 2310/0213; G09G 2310/0267; G09G 2310/0283
See application file for complete search history.

(56) References Cited

U.S. PATENT DOCUMENTS

| | | | | |
|---|---|---|---|---|
| 2006/0227090 | A1* | 10/2006 | Ishii | G09G 3/2011 345/98 |
| 2015/0170598 | A1 | 6/2015 | Jeon et al. | |
| 2017/0330503 | A1 | 11/2017 | Yang et al. | |
| 2018/0144679 | A1 | 5/2018 | Lee et al. | |
| 2018/0158396 | A1* | 6/2018 | Lee | G09G 3/2092 |
| 2018/0197482 | A1* | 7/2018 | Choi | G09G 3/3266 |
| 2018/0286315 | A1* | 10/2018 | Zhang | G09G 3/3685 |
| 2019/0019466 | A1* | 1/2019 | Tsunashima | G09G 3/3622 |

* cited by examiner

*Primary Examiner* — Liliana Cerullo
(74) *Attorney, Agent, or Firm* — Jaffery Watson Mendonsa & Hamilton LLP

(57) ABSTRACT

Aspects of the subject technology relate to electronic device display circuitry and methods of operating the display. The display circuitry includes gate-in-panel (GIP) drivers for each pixel row of a pixel array, and mode selection circuitry coupled between two of the GIP drivers. The mode selection circuitry receives a select signal to switch the display between a full-screen mode of operation and a split-screen mode of operation. The mode selection circuitry allows the pixel rows to be operated in a butterfly driving mode that facilitates reduction of optical artifacts when displaying augmented-reality or virtual-reality content with a multi-function display such as a display of a smartphone or a tablet.

20 Claims, 14 Drawing Sheets

SPLIT-SCREEN DRIVING OF ELECTRONIC DEVICE DISPLAYS

RELATED APPLICATIONS

This application claims the benefit of priority of U.S. Provisional Application No. 62/694,915 filed Jul. 6, 2018 which is incorporated herein by reference.

TECHNICAL FIELD

The present description relates generally to electronic device displays, and more particularly, but not exclusively, to split-screen driving of electronic device displays.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays (LCDs) are commonly provided in portable electronic devices and typically include an array of display pixels arranged in pixel rows and pixel columns. These displays are typically used to display a single image, multiple images, or a stream of images, such as a video stream, to be viewed by both eyes of the viewer.

Image and video content is also sometimes generated for separate viewing by the user's left and right eyes. For example, a movie theater can provide polarized or colored glasses or goggles to patrons that visually separate two concurrent (and commonly overlapping) images that, due to the separation of the viewer's eyes, add three-dimensional depth to the displayed concurrent images. This depth can be used to provide virtual reality (VR) content in which a three-dimensional computer-generated immersive environment is created for the user and/or to provide augmented reality (AR) content in which computer-generated content is added to a direct or camera-generated view of the real-world environment surrounding the user.

AR and VR content can also be provided with dedicated AR/VR devices that often include two separate displays, one for each eye of the users, and that mask out all other visual input to the user's eyes.

However, it can be difficult to provide this type of content on a multi-function device such as a smartphone or a tablet, without generating visible artifacts such as motion blur, luminance offsets, or other effects which can be unpleasant or even dizzying to a viewer.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
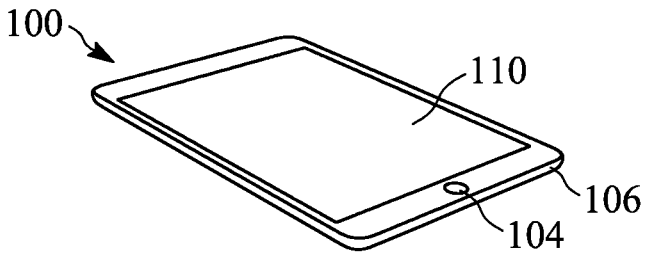
FIG. 1 illustrates a perspective view of an example electronic device having a display in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides control circuitry for electronic device displays such as organic light-emitting diode (OLED) displays, liquid crystal displays (LCDs), plasma displays, or displays based on other display technologies. In accordance with various aspects, the electronic device displays are gate-in-panel (GIP) displays in which control circuitry for operating the pixels of the display is disposed on the same substrate (panel) on which the pixels are formed (e.g., using thin-film transistor components on the substrate).

Displays as described herein may be included in electronic devices such as cellular telephones, media players, computers, set-top boxes, wireless access points, and other electronic equipment that may include displays. Displays are used to present visual information and status data and/or may be used to gather user input data. A display includes an array of display pixels. The array of display pixels is disposed in an active area of the display. The array of display pixels is arranged in pixel rows and pixel columns. Each display pixel may include one or more colored subpixels for displaying color images.

In some display modes, the entire display is operated to display an image (or string of image frames such as video frames) that are each intended to be viewed by both eyes of a viewer of the display. However, in some operating modes, the display is operated for split viewing of the display, in which a first portion (e.g., half) of the display is used to display content for the left eye of the viewer and a second portion (e.g., another half) of the display is used to display content for the right eye of the viewer.

For example, three-dimensional (3D) movie content, Augmented Reality (AR) applications that overlay virtual objects on a direct or camera view of the real-world environment, and Virtual Reality (VR) applications that generate three-dimensional virtual environments that are explorable by the user may utilize a split-screen view in which a first portion (e.g., half) of the display is used to display content for the left eye of the viewer and a second portion (e.g., another half) of the display is used to display content for the right eye of the viewer.

However, for some LCD and OLED displays (e.g., in a smartphone or tablet), visible artifacts can arise, particularly in a split-screen mode of operation. For example, motion blur can occur for fast-moving display objects. Moreover, common smartphone or tablet displays operate rows of pixels in a sequential manner from the top to the bottom of a pixel array, which can cause a visible systematic luminance offset for the left and right portions of the display in a split-screen mode of operation (e.g., due to a liquid crystal response delay in LCD displays). This can be particularly problematic if backlight strobing or pulsing is implemented to reduce motion blur.

In accordance with various aspects of the subject technology, display driver systems and methods are provided for split-screen driving of rows of display pixels, which can compensate and/or prevent the above-noted artifacts.

An illustrative electronic device having a display is shown in FIG. 1. In the example of FIG. 1, device 100 has been implemented using a housing that is sufficiently small to be portable and carried by a user (e.g., device 100 of FIG. 1 may be a handheld electronic device such as a tablet computer or a cellular telephone). As shown in FIG. 1, device 100 includes a display such as display 110 mounted on the front of housing 106. Display 110 may be a gate-in-panel (GIP) display that includes active display pixels in an active area (AA) of the display and control circuitry for operating the active display pixels an inactive portion. Display 110 may have openings (e.g., openings in the inactive or active portions of display 110) such as an opening to accommodate button 104 and/or other openings such as an opening to accommodate a speaker, a light source, or a camera.

Display 110 may be a touch screen that incorporates capacitive touch electrodes or other touch sensor components or may be a display that is not touch-sensitive. Display 110 includes display pixels formed from light-emitting diodes (LEDs), organic light-emitting diodes (OLEDs), plasma cells, electrophoretic display elements, electrowetting display elements, liquid crystal display (LCD) components, or other suitable display pixel structures. Arrangements in which display 110 is formed using OLED display pixels and GIP control circuitry are sometimes described herein as an example. This is, however, merely illustrative. In various implementations, any suitable type of display pixel technology may be used in forming display 110 if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a somewhat smaller portable device such as a wrist-watch device, a pendant device, or other wearable or miniature device, a media player, a gaming device, a navigation device, a computer monitor, a television, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations.

In some implementations, electronic device 100 is provided in the form of a computer integrated into a computer monitor. Display 110 may be mounted on a front surface of housing 106 and a stand may be provided to support housing (e.g., on a desktop).

Figure 2:
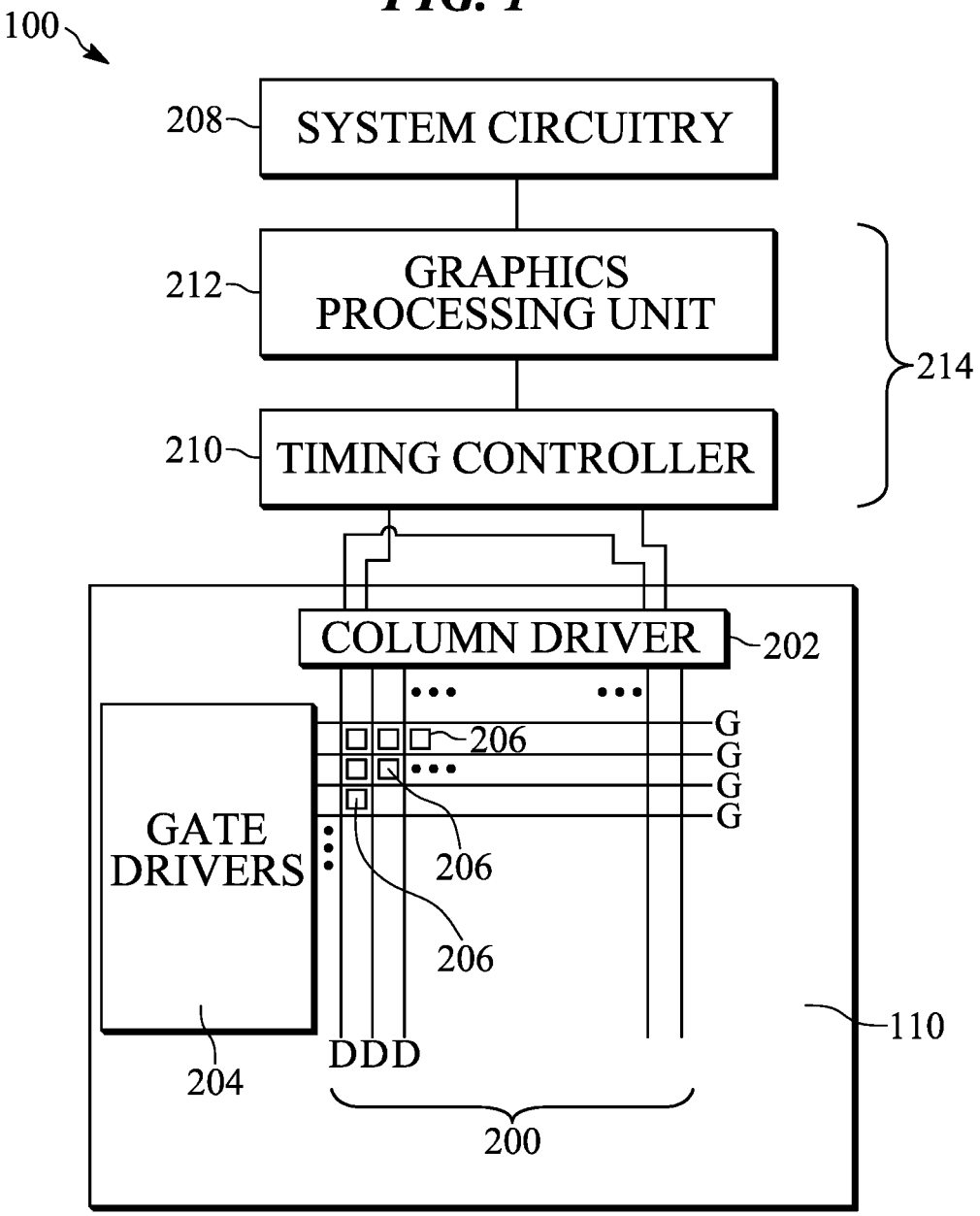
FIG. 2 illustrates a schematic diagram of exemplary display circuitry in accordance with various aspects of the subject technology.

FIG. 2 is a schematic diagram of device 100 showing illustrative circuitry that may be used in displaying images for a user of device 100 on pixel array 200 of display 110. As shown in FIG. 2, display 110 may include column driver circuitry 202 that drives data signals (analog voltages) onto the data lines D of array 200. Gate driver circuitry 204 may drive gate line signals onto gate lines G of array 200.

Using the data lines D and gate lines G, display pixels 206 may be operated to display images on display 110 for a user. In some implementations, gate driver circuitry 204 may be implemented using thin-film transistor circuitry on a display substrate such as a glass or plastic display substrate or may be implemented using integrated circuits that are mounted on the display substrate or attached to the display substrate by a flexible printed circuit or other connecting layer. For example, gate driver circuitry 204 may include a plurality of gate-in-panel (GIP) driver circuits directly formed on the display panel substrate (e.g., each configured to provide a gate signal along a corresponding one of signal gate lines G for a corresponding row of display pixels 206. In some implementations, column driver circuitry 202 may be implemented using one or more column driver integrated circuits that are mounted on the display substrate or using column driver circuits mounted on other substrates.

Device 100 may include system circuitry 208. System circuitry 208 may include one or more different types of storage such as hard disk drive storage, nonvolatile memory (e.g., flash memory or other electrically-programmable-read-only memory), volatile memory (e.g., static or dynamic random-access-memory), magnetic or optical storage, permanent or removable storage and/or other non-transitory storage media configure to store static data, dynamic data, and/or computer readable instructions for processing circuitry in system circuitry 208. Processing circuitry in system circuitry 208 may be used in controlling the operation of device 100. Processing circuitry in system circuitry 208 may sometimes be referred to herein as system circuitry or a system-on-chip (SOC) for device 100.

The processing circuitry may be based on a processor such as a microprocessor and other suitable integrated circuits, multi-core processors, one or more application specific integrated circuits (ASICs) or field programmable gate arrays (FPGAs) that execute sequences of instructions or code, as examples. In one suitable arrangement, system circuitry 208 may be used to run software for device 100, such as internet browsing applications, email applications, media playback applications, operating system functions, software for capturing and processing images, augmented reality (AR) applications, virtual reality (VR) applications, three-dimensional (3D) video applications, etc.

During operation of device 100, system circuitry 208 may generate or receive data that is to be displayed on display 110. This display data may be processed, scaled, modified, and/or provided to display control circuitry such as graphics processing unit (GPU) 212. For example display frames, including display pixel values (e.g., each corresponding to a grey level) for display using pixels 206 (e.g., colored subpixels such as red, green, and blue subpixels) may be provided from system circuitry 208 to GPU 212. GPU 212 may process the display frames and provide processed display frames to timing controller integrated circuit 210.

Timing controller 210 provides digital display data (e.g., the digital pixel values each corresponding to a grey level for display) to column driver circuitry 202. Column driver circuitry 202 may receive the digital display data from timing controller 210. Using digital-to-analog converter circuitry within column driver circuitry 202, column driver circuitry 202 may provide corresponding analog output signals on the data lines D running along the columns of display pixels 206 of array 200.

Graphics processing unit 212 and timing controller 210 may sometimes collectively be referred to herein as display control circuitry 214. Display control circuitry 214 may be used in controlling the operation of display 110. Display control circuitry 214 may sometimes be referred to herein as a display driver, a display controller, a display driver integrated circuit (IC), or a driver IC. Graphics processing unit 212 and timing controller 210 may be formed in a common package (e.g., an SOC package) or may be implemented separately (e.g., as separate integrated circuits). In some implementations, timing controller 210 may be implemented separately as a display driver, a display controller, a display driver integrated circuit (IC), or a driver IC that receives processed display data from graphics processing unit 212. Accordingly, in some implementations, graphics processing unit 212 may be considered to be part of the system circuitry (e.g., together with system circuitry 208) that provides display data to the display control circuitry (e.g., implemented as timing controller 210, gate drivers 204, and/or column drivers 202). Although a signal gate line G and a single data line D for each pixel 206 are illustrated in FIG. 2, this is merely illustrative and one or more additional row-wise and/or column-wise control lines may be coupled to each pixel 206 in various implementations.

Figure 3:
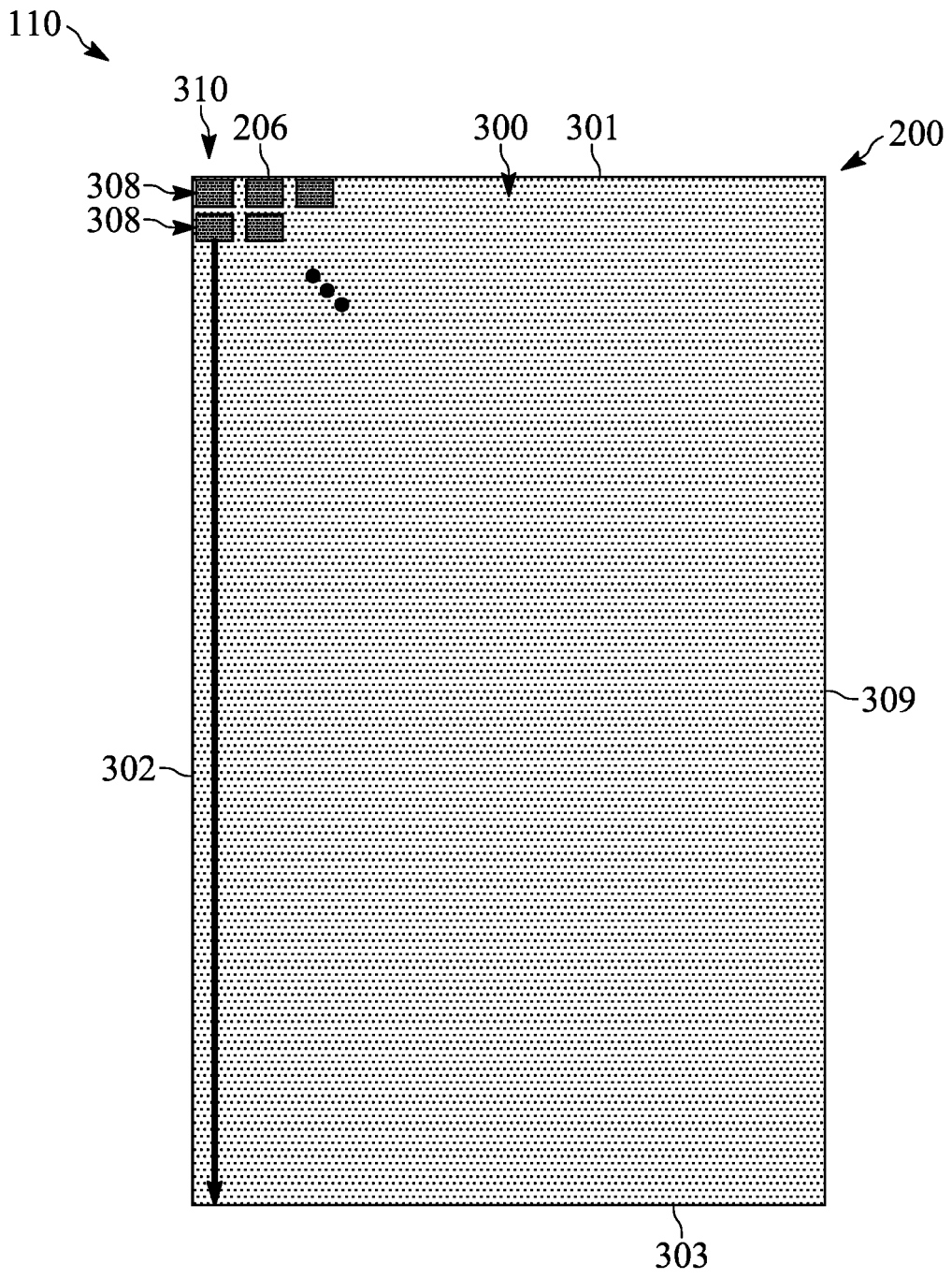
FIG. 3 illustrates a schematic diagram of a pixel array in a full-screen mode of operation in accordance with various aspects of the subject technology.
Figure 4:
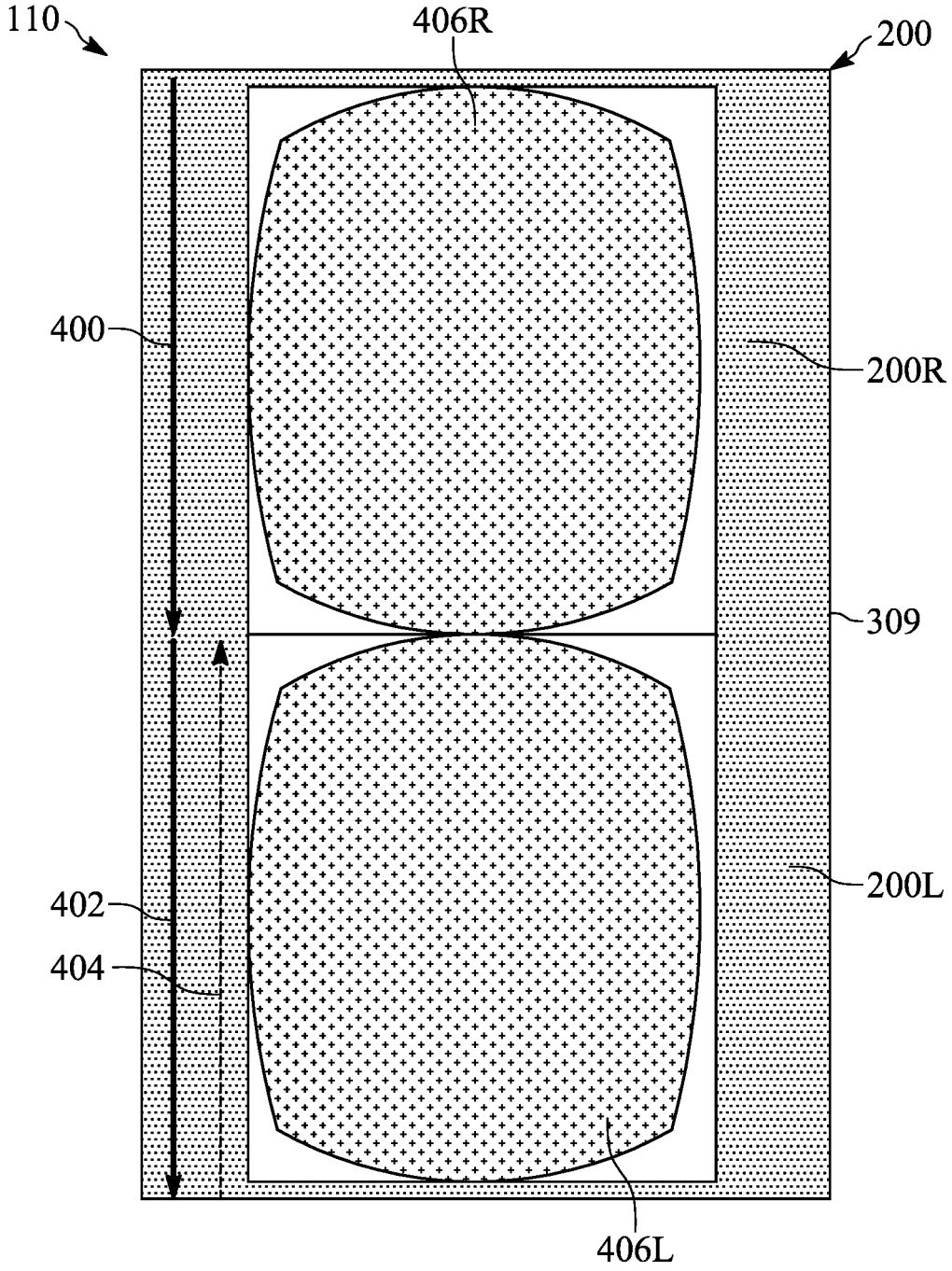
FIG. 4 illustrates a schematic diagram of a pixel array in a split-screen mode of operation in accordance with various aspects of the subject technology.

FIGS. 3 and 4 illustrate operations of pixel array 200 of display 110, in a full-screen mode of operation and a split-screen mode of operation respectively. As described in further detail hereinafter, display 110 includes display circuitry for making a seamless switch between the full-screen mode of operation illustrated in FIG. 3, and the split-screen mode of operation illustrated in FIG. 4.

As shown in FIG. 3, display pixels 206 are arranged in pixel rows 308 and pixel columns 310. In the example of FIG. 3, full screen content 300 is displayed using pixels 206 by driving pixel rows 308 sequentially across the entire array from a topmost pixel row 308 located at a top end 301 of pixel array 200, as indicated by arrow 302, across a center 309 of pixel array 200 to a bottommost row located at a bottom end 303 of pixel array 200. In the example of FIG. 4, split-screen content including left-eye content 406L and right-eye content 406R, is displayed. Left-eye content 406L is displayed using pixels rows 308 of a left portion 200L (e.g., a left half on a left side of center 309) of display 110 and right-eye content 406R is displayed using pixel rows 308 of a right portion 200R (e.g., a right half on a right side of center 309) of display 110.

As indicated by arrows 400 and 402, in the split-screen mode, the pixel rows 308 of right portion 200R and left portion 200L, for a single display frame, are alternatingly operated so that the outermost pixel row 308 of the pixels rows of right portion 200R (e.g., on the right side of center 309) is operated first, a centermost pixel row 308 of the pixels rows of left portion 200L (e.g., on the left side of, and adjacent to, center 309) is operated second, and, immediately after the centermost pixel row 308 of the pixels rows of left portion 200L, a pixel row 308 that is adjacent to the outermost pixel row of the pixels rows of right portion 200R is operated. This alternating pattern may be repeated until the outermost pixel row 308 of left portion 200L is operated to display the last row of display pixels of left-eye content 406L, to perform a right-to-left alternating pixel row operation.

Figure 5:
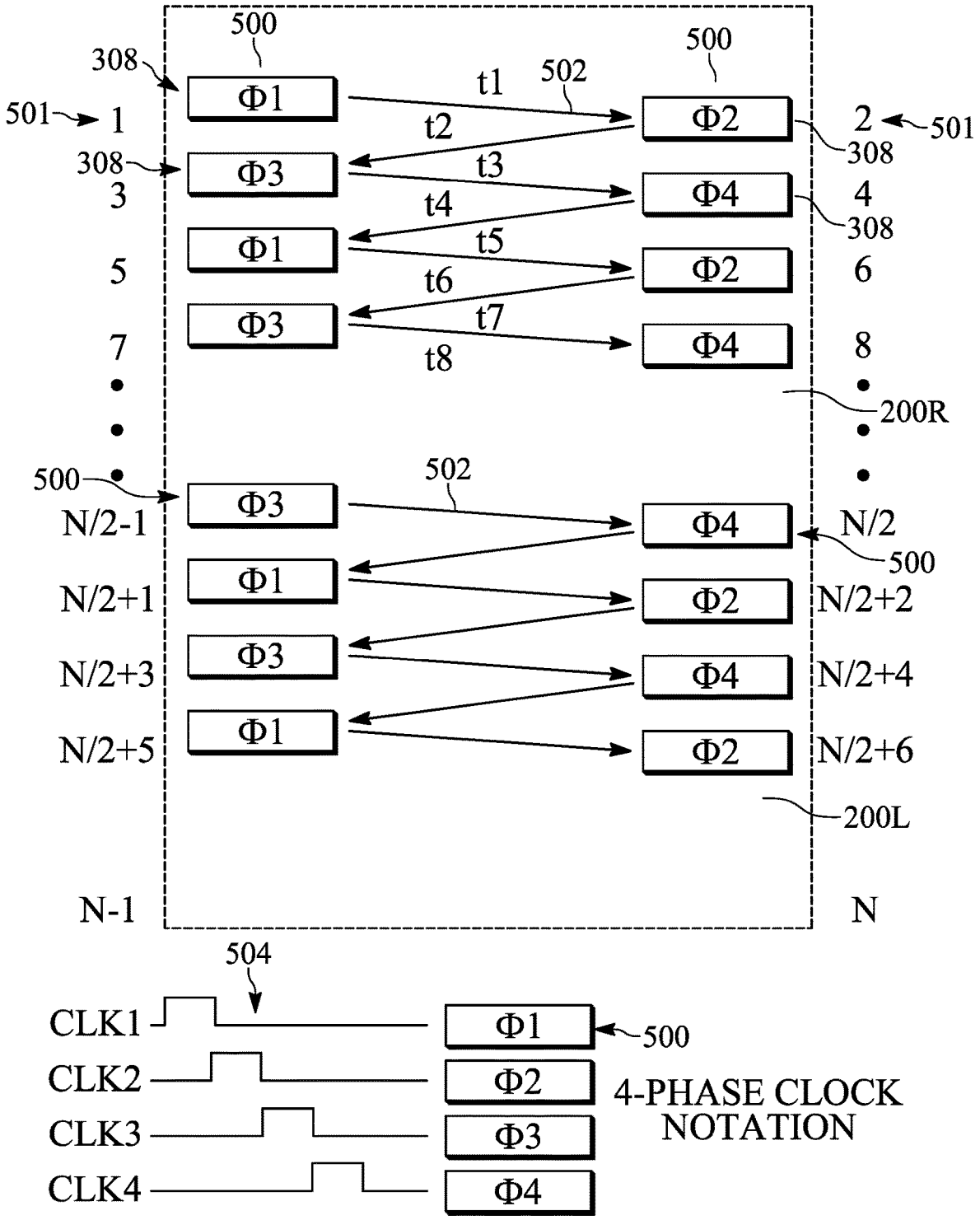
FIG. 5 illustrates a schematic diagram for sequential row driving for a display in a full-screen mode of operation in accordance with various aspects of the subject technology.
Figure 6:
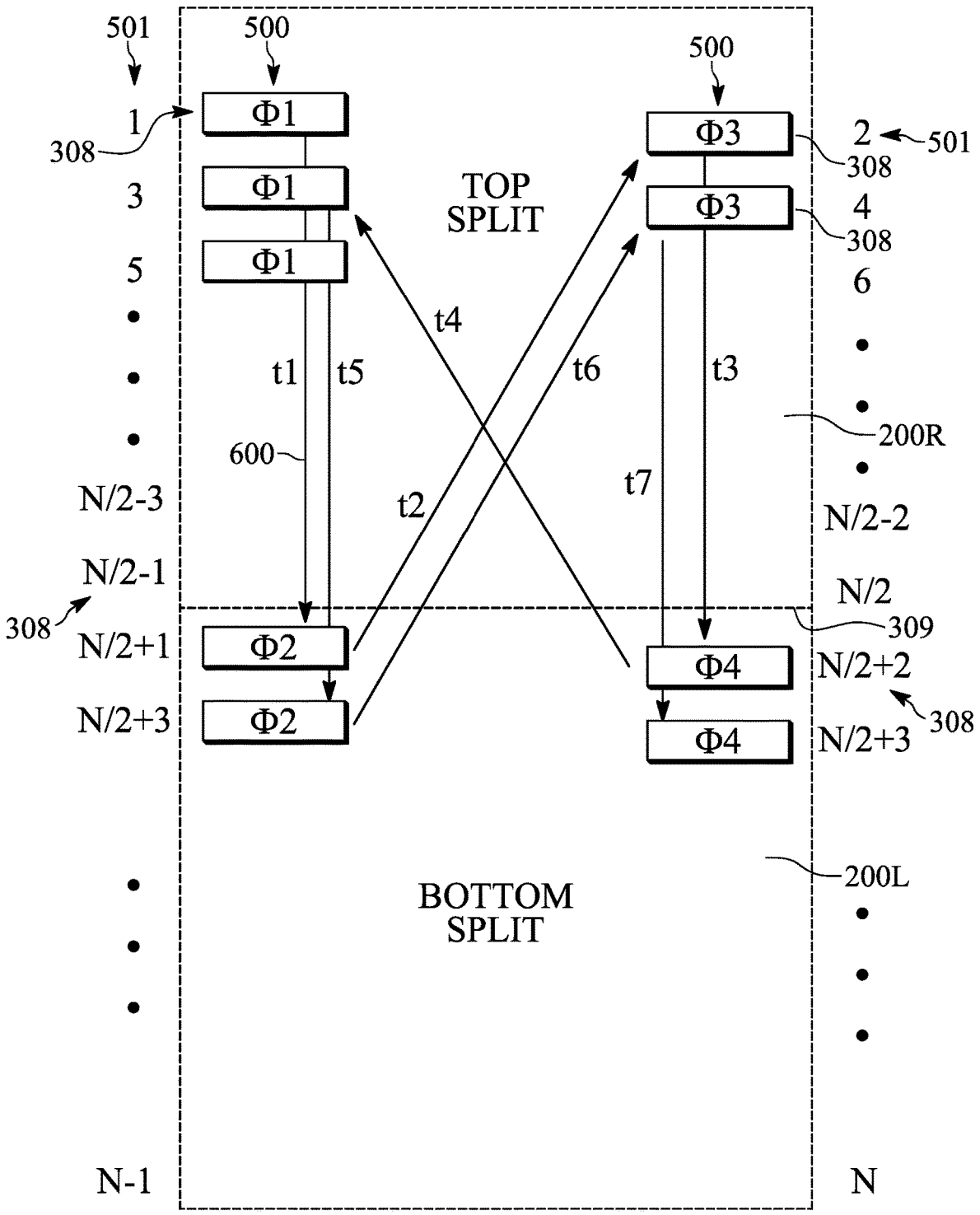
FIG. 6 illustrates a schematic diagram for alternating row driving in a split-screen mode of operation in accordance with various aspects of the subject technology.

Further details of the sequential full-screen and right-to-left split screen operations illustrated in FIGS. 3 and 4 are shown in FIGS. 5 and 6. However it should also be appreciated that, for the split-screen mode, pixel rows 308 can be operated in other alternating orders such as an outside-in order (e.g., an order in which the pixel rows of both halves of the pixel array are alternatingly operated from the outer edge toward the center, as indicated by the combination of arrow 400 and 404), an inside-out order (e.g., an order in which the pixel rows or each half are alternatingly operated from the center out), or an alternating left-right, outside-in, or inside-out order for groups of pixel rows on opposing sides of center 309, as described in further detail hereinafter.

FIG. 5 illustrates a schematic diagram of the sequential operation of pixel rows 308 for a full-screen mode of operation for display 110. In the diagram of FIG. 5, row numbers 501 are indicated with the first row "1" being the outermost row at the top end 301 of the display, row "N" being the last or outermost row at the opposing bottom end 303 of the display, with row "N/2" being the last or centermost row on the right side of center 309, and row "N/2+1" being the first or centermost row on the left side of the center 309. Arrows 502, each labeled with a time order t1, t2, t3, etc., indicate the order in which pixel rows 308 are operated in the full-screen mode.

FIG. 5 also illustrates an example in which four phase clocks are used to control the timing of the pixel row operations. In the example of FIG. 5, the phase 500 of the operation of each pixel row 308 is labeled with one of phases $\Phi_1$, $\Phi_2$, $\Phi_3$, or $\Phi_4$, corresponding to the relative timing indicated by timelines 504 for respective clock signals CLK1, CLK2, CLK3, and CLK4. As shown in the example of FIG. 5, pixel rows 308 are operated sequentially in order from row 1 through row N, with four phase clocks corresponding to the four phases $\Phi_1$, $\Phi_2$, $\Phi_3$, and $\Phi_4$.

FIG. 6 illustrates (using the same notation, row labeling, and phase labeling as in FIG. 5) a right-to-left alternating row operation for a split-screen mode of operation for display 110. The term "right-to-left" is used for convenience to describe alternating row driving in which the pixel rows in each half of the pixel array proceed in the same direction (e.g., from top end 301). However, it should be appreciated that the terms "left" and "right" are for illustrative purposes and the operations described herein can be reversed for a left-to-right alternating row operation, without deviating from the scope of the disclosure, or the right-to-left operations can be observed differently relative to a viewing user depending on the orientation of the device relative to the user.

As shown in FIG. 6 (e.g., as indicated by timing arrows 600), for a split-screen mode of operation, pixel row 1 (e.g., the outermost pixel row 308 of the pixels rows of right portion 200R) may be operated first, row N/2+1 (e.g., the centermost pixel row 308 of the pixels rows of left portion 200L) is operated second, and (immediately after row N/2+1) pixel row 2 (adjacent to row 1) is operated. As illustrated in FIG. 6, this alternating pattern (e.g., pixel rows 1, N/2+1, 2, N/2+2, 3, N/2+3 . . . ) may be repeated until row N (e.g., the outermost pixel row 308 of left portion 200L) is operated.

In another example, an outside-in alternating row operation may be performed for the split-screen mode in which alternatingly operating the pixels rows on the first side and the pixel rows on the second side of the display includes operating pixel row 1 (e.g., the outermost pixel row 308 of the pixels rows of right portion 200R) first, operating pixel row N (e.g., the outermost pixel row 308 of the pixels rows of left portion 200L) second (e.g., immediately after row 1), and (immediately after row N) operating pixel row 2 (adjacent to row 1). This alternating pattern (e.g., pixel rows 1, N, 2, N−1, 3, N−2 . . . ) may be repeated until row N/2+1 (e.g., the centermost pixel row 308 of left portion 200L) is operated.

In another example, an inside-out alternating row operation may be performed for the split-screen mode in which alternatingly operating the pixels rows on the first side and the pixel rows on the second side of the display includes operating pixel row N/2 (e.g., the centermost pixel row 308 of the pixels rows of right portion 200R) first, operating pixel row N/2+1 (e.g., the centermost pixel row 308 of the pixels rows of left portion 200L) second (e.g., immediately after row N/2), and (e.g., immediately after row N/2+1) operating pixel row N/2−1 (adjacent to row N/2). This alternating pattern (e.g., pixel rows N/2, N/2+1, N/2−1, N/2+2, N/2−2 . . . ) may be repeated until row N (e.g., the outermost pixel row 308 of left portion 200L) is operated.

In order to facilitate a seamless switch between full-screen and split-screen modes of operation as described herein, display 110 may be provided with mode control circuitry coupled between row control circuitry for pixel rows on opposing sides (e.g., pixel rows in left and right portions 206L and 206R) of the pixel array. For example, FIG. 7 shows an example in which display control circuitry 750 of display 110 includes mode control circuitry such as multiplexer 702 coupled between row control circuitry on opposing sides of the center 309 of display 110, which is indicated by a horizontal centerline 633 in FIG. 7.

Figure 7:
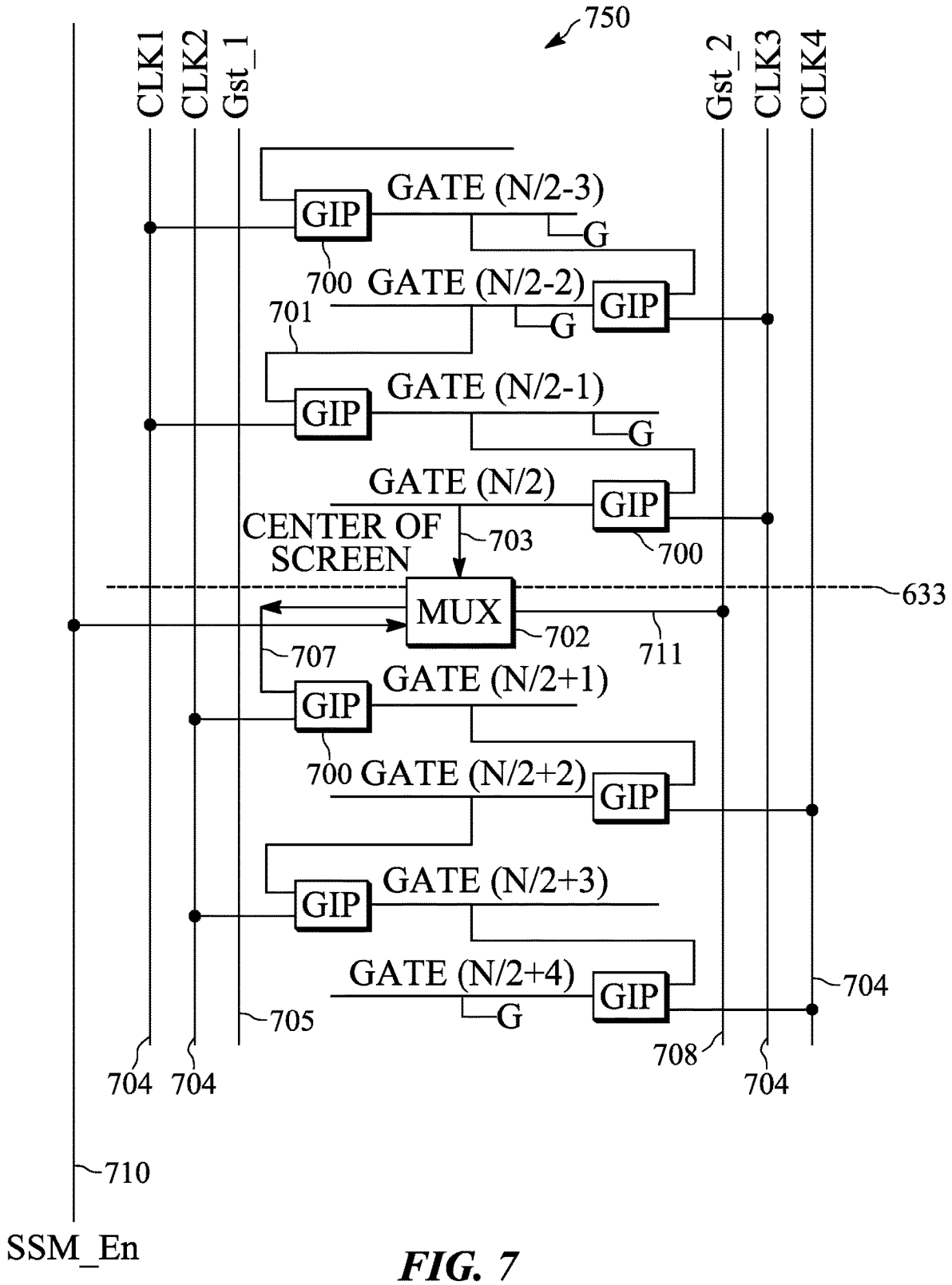
FIG. 7 illustrates a schematic diagram of display circuitry in a full-screen mode of operation in accordance with various aspects of the subject technology.

In the example of FIG. 7, row control circuitry for pixel rows N/2−3 through N/2+4, in the vicinity of horizontal centerline 633, are shown. The horizontal centerline 633 represents the centerline between a first half of the pixel rows (e.g., pixel rows 1 through N/2) on a top side of horizontal centerline 633 (corresponding to right portion 200R in FIGS. 4-6) and a second half of the pixel rows (e.g., pixel rows N/2+1 through N) disposed on a bottom side of horizontal centerline 633 (corresponding to left portion 200L in FIGS. 4-6).

In the example, of FIG. 7, display control circuitry 750 includes a gate-in-panel (GIP) driver 700 for each pixel row 308. Each GIP driver 700 may include a shift register that includes cascaded stages to sequentially generate the gate signals on gate lines G. As shown in FIG. 7, display control circuitry 750 also includes mode control circuitry 702 (e.g., a multiplexer) coupled between an output terminal of GIP driver 700 of pixel row N/2 (e.g., the centermost pixel row 308 in portion 200R) and an input terminal of GIP driver 700 of pixel row N/2+1 (e.g., the centermost pixel row 308 in portion 200L).

As shown in FIG. 7, each GIP driver 700 receives one of clock signals CLK1, CLK2, CLK3, and CLK4, corresponding to the four phases $\Phi_1$, $\Phi_2$, $\Phi_3$, and $\Phi_4$ described above in connection with FIGS. 5 and 6, along a corresponding clock signal line 704.

As shown in FIG. 7, each GIP driver 700, except for the GIP drivers 700 for pixel rows 1 and N/2+1, receives a start signal from a GIP driver 700 of the previous row (along a signal line 701). GIP driver 700 for pixel row 1 receives a start signal GST1 from a signal line 705. GIP driver 700 for pixel row N/2+1 instead receives a start signal from multiplexer 702. As shown, multiplexer 702 is configured to receive a selection single SSM_En along a select line 710, an output signal from GIP driver 700 of pixel row N/2−1 along line 703, and an additional start signal GST2 along an additional signal line 708. GIP driver 700 of the first pixel row (e.g., row 1) receives a start signal GST1 that is different from the start signal GST2 received by multiplexer 702.

In the configuration shown in FIG. 7, the select signal provided to multiplexer 702 along select line 710 causes multiplexer 702 to provide the start signal received along line 705 from GIP driver 700 of row N/2−1 to the GIP driver 700 of pixel row N/2+1, along line 707. In this way, a sequential operation of pixel rows 308 is generated since each pixel row, including pixel row N/2+1 is initiated based on a start signal from the previous row.

Figure 8:
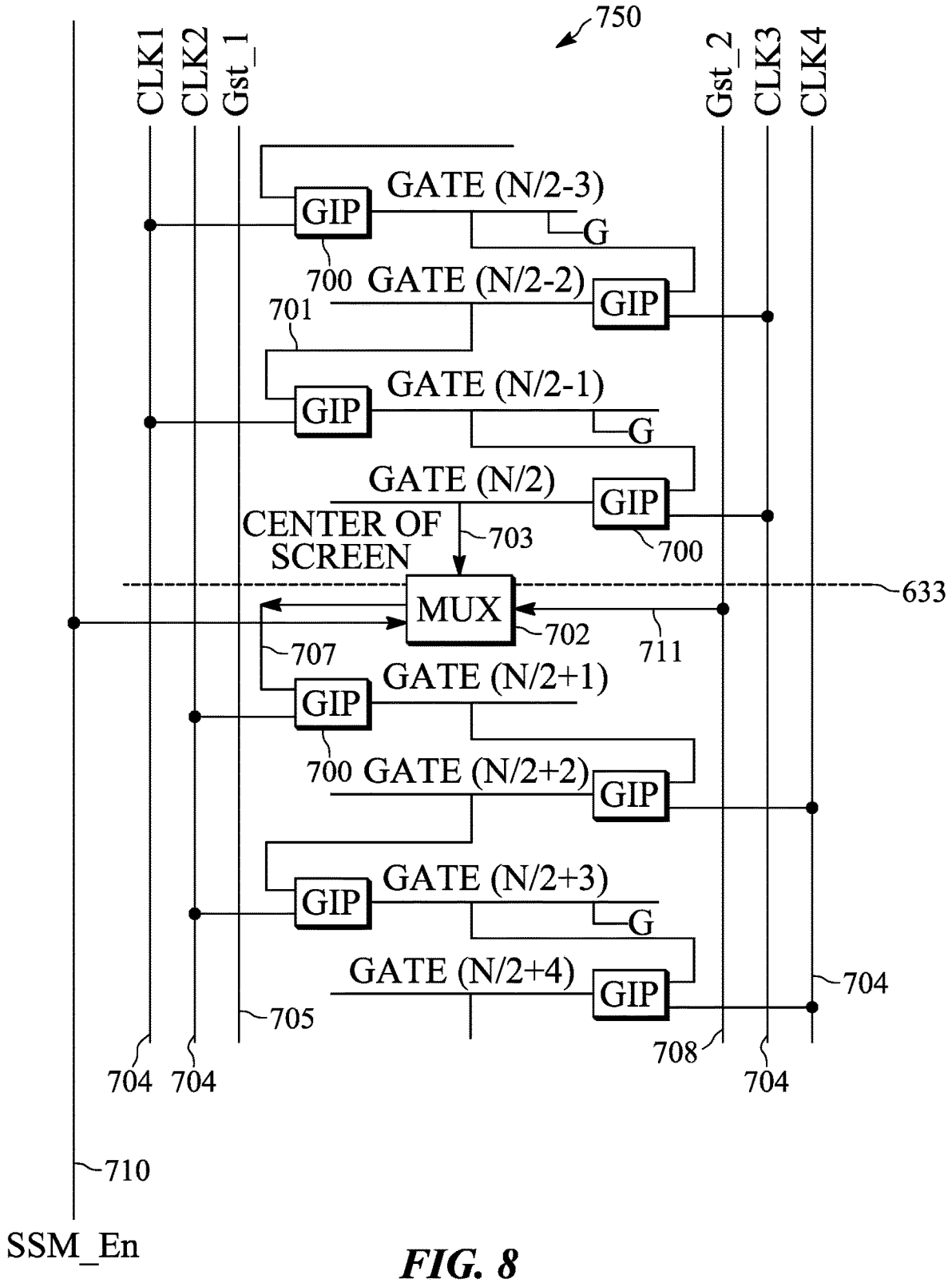
FIG. 8 illustrates a schematic diagram of display circuitry in a split-screen mode of operation in accordance with various aspects of the subject technology.

However, as shown in FIG. 8, the select signal provided to multiplexer 702 along select line 710 may instead be set to cause multiplexer 702 to provide GIP driver 700 of pixel row N/2+1 with the additional start signal GST2 that was received along line 711 from start signal line 708. In this way, along with the appropriate timing of clock signals CLK1, CLK2, CLK3, and CLK4, an alternating operation of pixel rows 308 is generated for a split-screen mode of operation for display 110.

Figure 9:
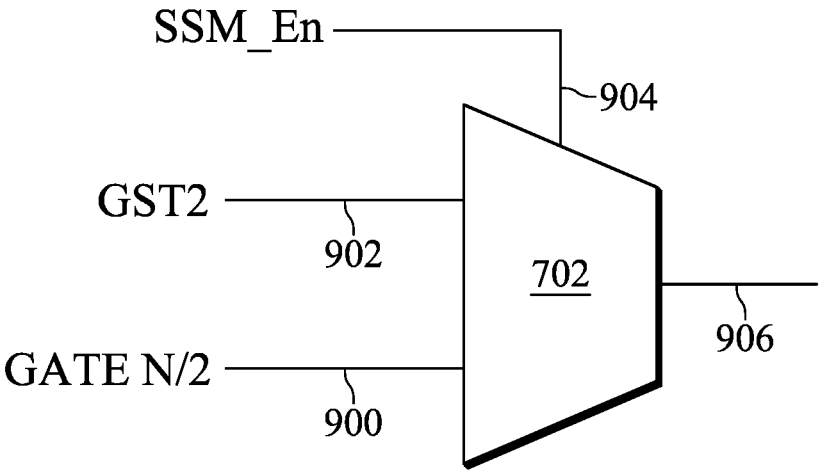
FIG. 9 illustrates a schematic diagram of a multiplexer of the display circuitry of FIGS. 7 and 8 in accordance with various aspects of the subject technology.

FIG. 9 illustrates a schematic diagram of multiplexer 702 showing how multiplexer 702 may include a first input terminal 900 coupled (via line 703 of FIGS. 7 and 8) to the output terminal of the GIP driver 700 of row N/2, a second input terminal 902 configured to receive a start signal GST2 (via line 708 and 711 of FIGS. 7 and 8), and an output terminal 906 coupled (via line 707 of FIGS. 7 and 8) to the input terminal of GIP driver 700 of pixel row N/2+1.

As shown in FIG. 9, multiplexer 702 also includes a selector pin 904 configured to receive an enable signal SSM_En (via line 710 of FIGS. 7 and 8) that couples first input terminal 900 to output terminal 906 for a full-screen mode of operation for the display and couples second input terminal 902 to output terminal 906 for a split-screen mode of operation for the display.

Figure 10:
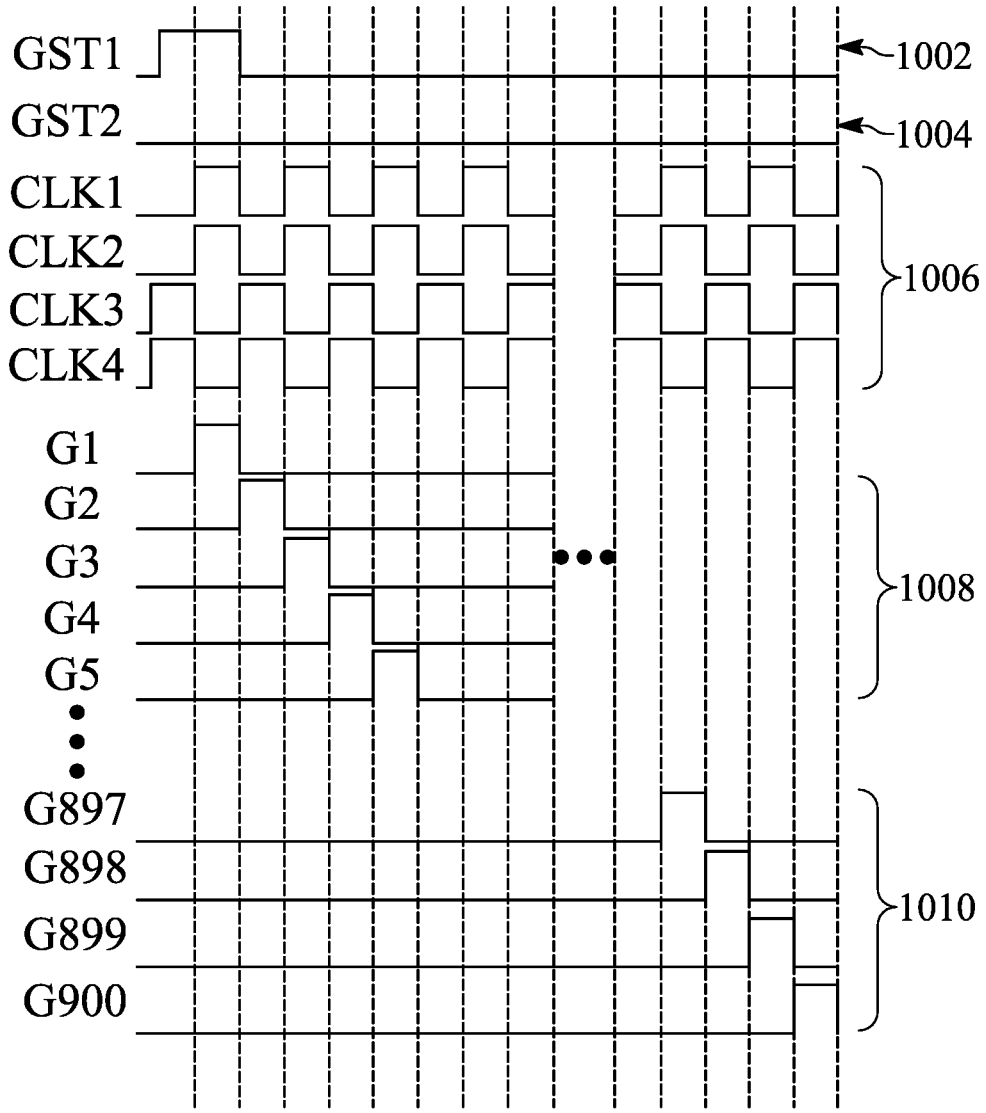
FIG. 10 illustrates a timing diagram for operation of a display in a full-screen mode of operation in accordance with various aspects of the subject technology.
Figure 11:
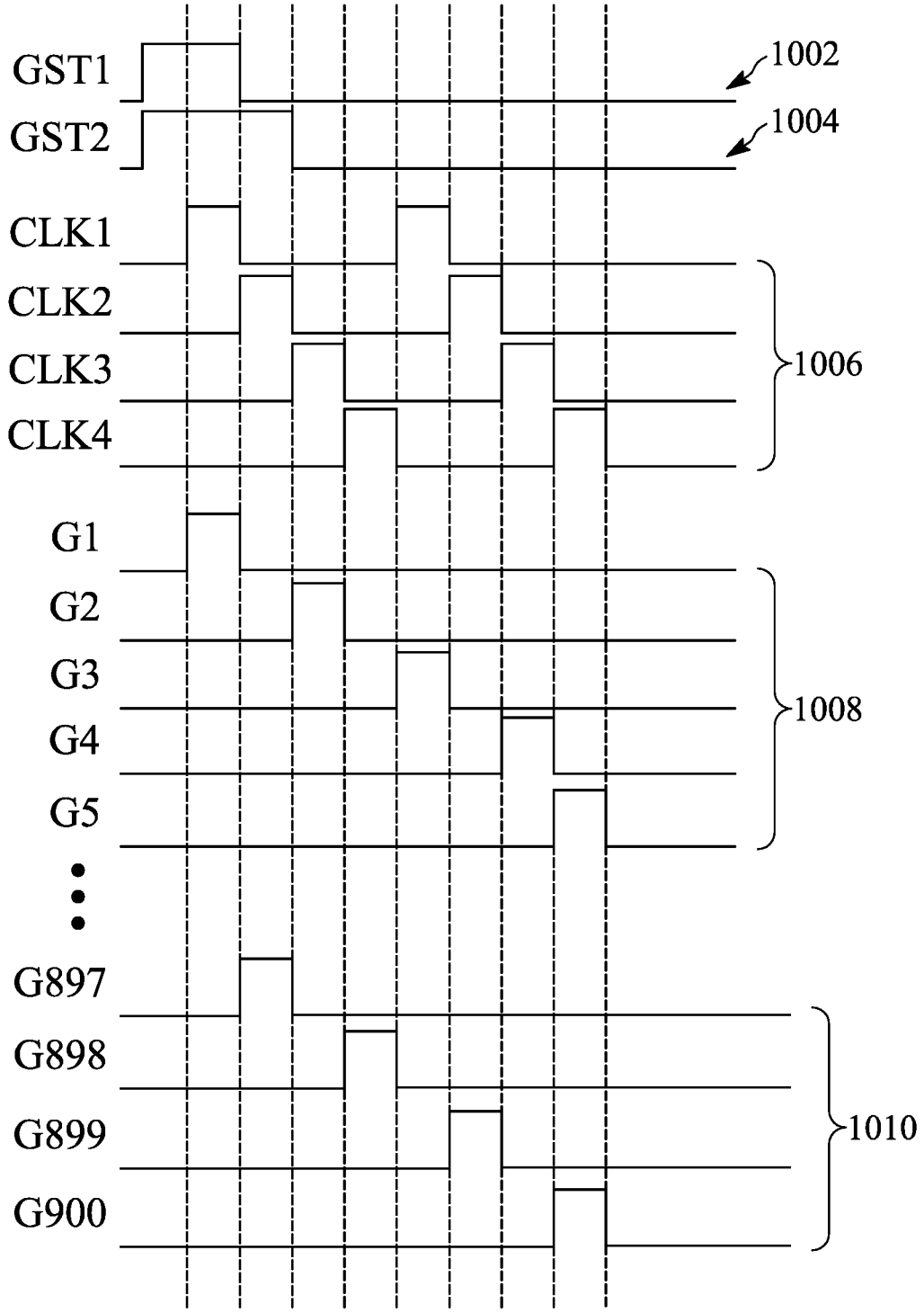
FIG. 11 illustrates a timing diagram for operation of a display in a split-screen mode of operation in accordance with various aspects of the subject technology.

FIGS. 10 and 11 respectively illustrate timing diagrams for the full-screen mode of operation of FIGS. 5 and 7, and the split-screen mode of operation of FIGS. 6 and 8. As shown in FIG. 10, for the full-screen mode of operation in which the select signal SSM_En (not shown) causes multiplexer 702 to provide the start signal to pixel row N/2+1 from pixel row N/2, a start signal GST1 includes a start pulse (see timeline 1002) and start signal GST2 is maintained low (see timeline 1004) for the entire display frame.

In the full-screen mode of FIG. 10, clock signal timelines 1006 show that clock signals CLK1 and CLK2 are overlapping and clock signals CLK3 and CLK4 are overlapping. As shown by gate signal timelines 1008 for gate lines G1–G(N/2) of pixel rows 1–N/2 of the first half of the pixel array, and gate signal timelines 1010 for gate lines G(N/2+1)–G(N) of pixel rows N/2+1 through N of the second half of the pixel array (e.g., including the first four gate lines G897-G900 of the second half), the gate pulses of all gate lines gate lines G1–G(N) are sequentially provided.

In contrast, FIG. 11 shows how, in the split-screen mode of operation, clock signals CLK1, CLK2, CLK3, and CLK4 are sequentially phased and start signal GST2 includes a start pulse that is one clock longer that start pulse GST1, such that the sequential gate pulses of gate lines G1–G(N/2) of the first half of the pixel array alternate and are interleaved with the sequential gate pulses of gate lines G(N/2+1)–G(N) of the second half of the pixel array.

In the examples described above in connection with FIGS. 5-11, alternating pixel row operations for a split-screen mode of operation for display 110 alternatingly operate single pixel rows on each side of a center of the display. However, it should also be appreciated that alternating pixel row operations for a split-screen mode of operation for display 110 may include alternatingly operating groups of pixel rows.

Figure 12:
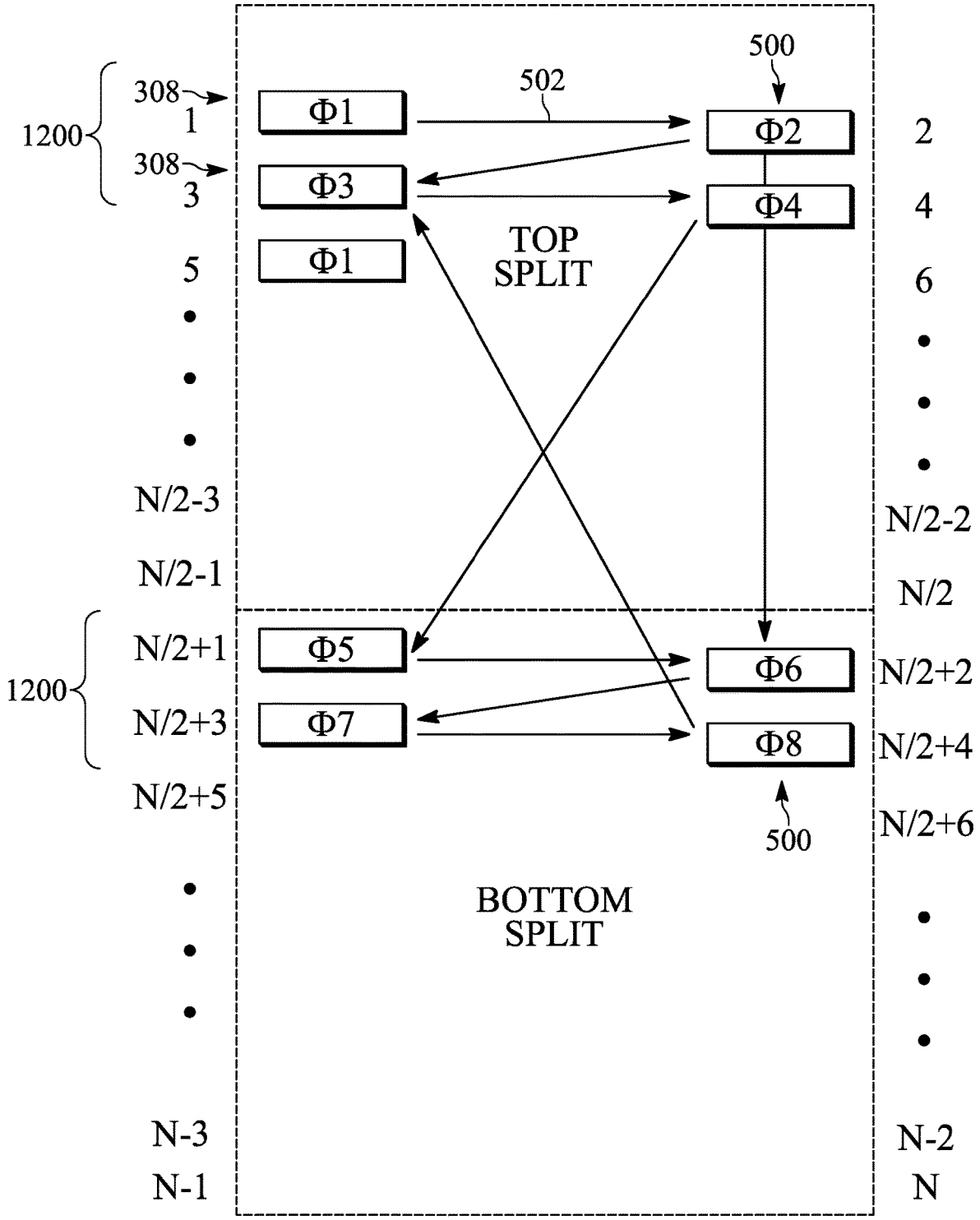
FIG. 12 illustrates a schematic diagram for alternating row group driving in a split-screen mode of operation in accordance with various aspects of the subject technology.
Figure 13:
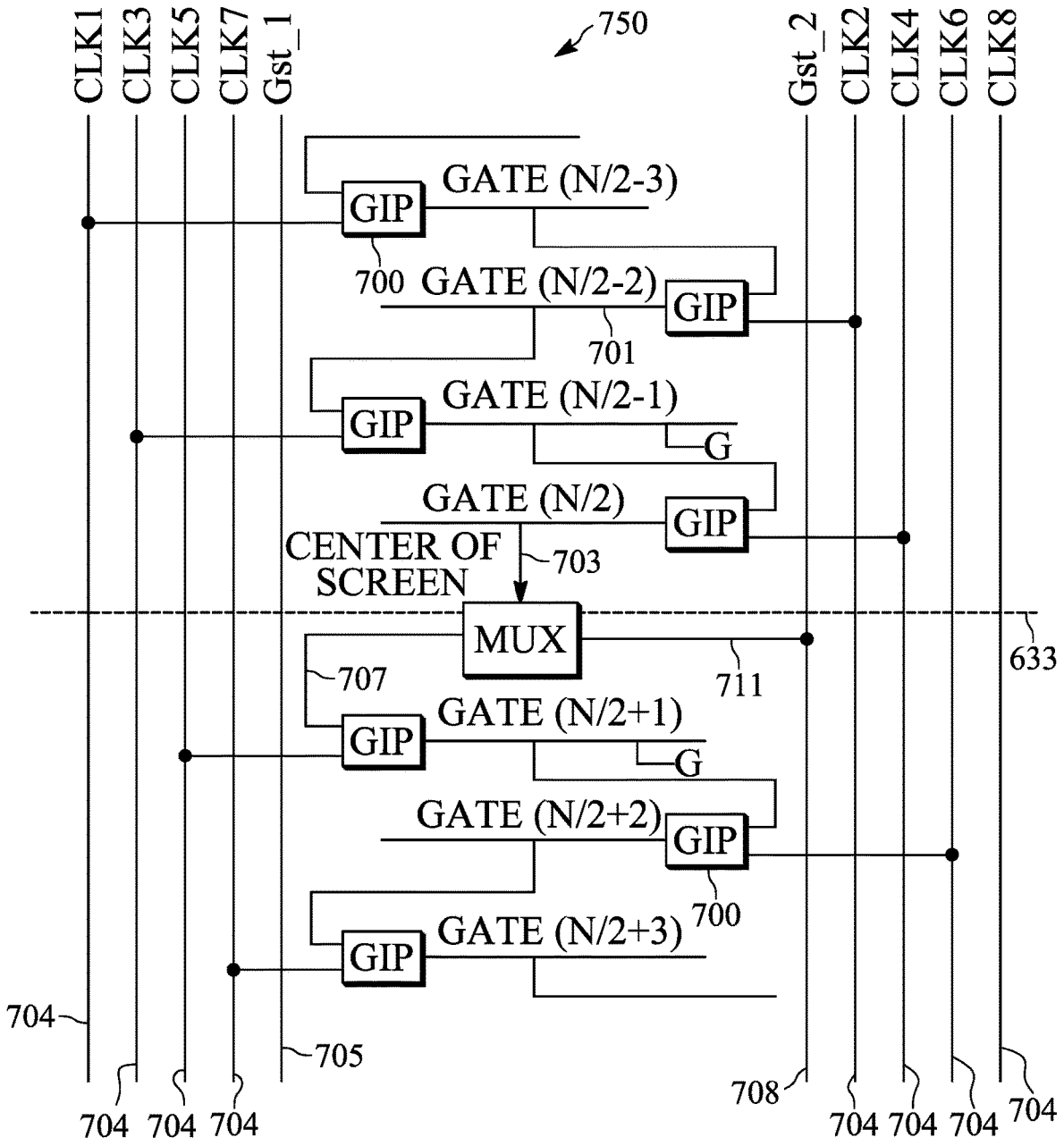
FIG. 13 illustrates a schematic diagram of display circuitry for providing an alternating row group split-screen mode of operation in accordance with various aspects of the subject technology.
Figure 14:
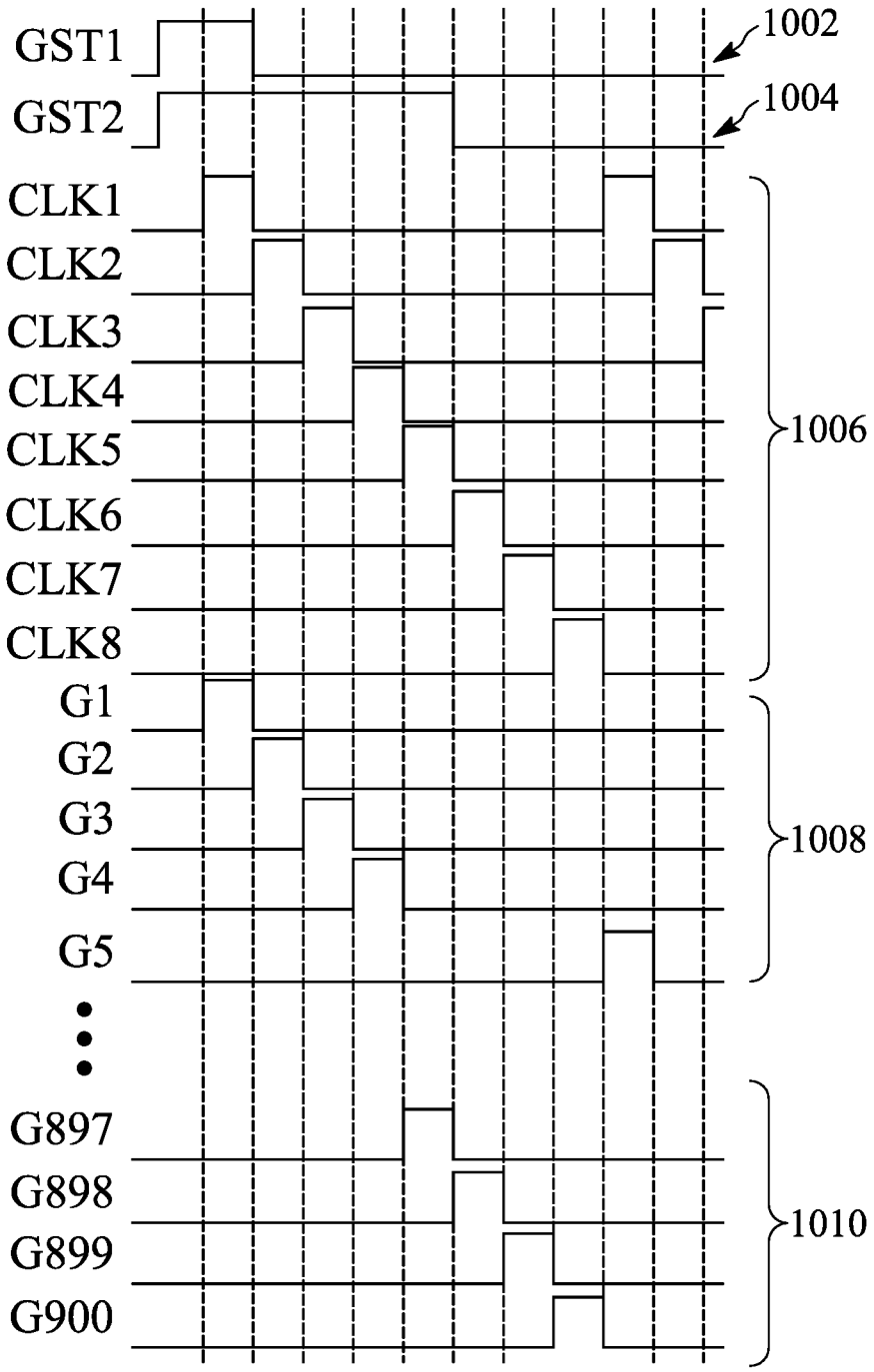
FIG. 14 illustrates a timing diagram for operation of a display in an alternating row group split-screen mode of operation in accordance with various aspects of the subject technology.

For example, FIGS. 12, 13, and 14 illustrate alternating pixel row operations for a split-screen mode of operation for display 110 in which groups of four pixel rows are ditheringly alternated to provide split-screen viewing with reduced optical artifacts in some scenarios. In the example, FIG. 12 arrows 502 and phases 500 indicate that groups 1200 of four pixel rows 308 on one side of center 309 are sequentially operated before a next group 1200 of four pixel rows 308 on an opposing side of center 309 are sequentially operated. Groups 1200 on opposing sides of centerline 633 are alternatingly operated.

For example, similar to the operations described above in connection with FIG. 5, in a split-screen dithering mode of operation, an outermost group 1200 of the pixels rows 308 on the first side of center 309 (e.g., pixel rows 1 through 4) may be operated first. Immediately after the outermost group of the pixels rows on the first side is operated, a centermost group 1200 of the pixels rows 308 on the second side of center 309 (e.g., pixel rows N/2+1 through N/2+4) may be operated. Immediately after the centermost group 1200 of the pixels rows 308 on the second side, a group 1200 of pixel rows 308 that is adjacent to the outermost group 1200 of the pixels rows 308 (e.g., pixel rows 5-8) on the first side may be operated. This alternating pattern may be repeated until the outermost group 1200 on the second side (e.g., including pixel rows N–3 through N) are sequentially operated. It should also be appreciated that an inside-out or outside-in alternating operation may also be performed for groups 1200.

As shown in FIG. 13, for a split-screen dithering mode of operation, display circuitry 750 may include eight clock lines 704 for providing eight clock signals CLK1, CLK2, CLK3, CLK4, CLK5, CLK6, CLK7, and CLK8 to GIP drivers 700 with eight clock phases $\Phi_1$-$\Phi_8$. FIG. 14 is a timing diagram showing how, for a split-screen dithering mode of operation with groups 1200 including four pixel rows 308, a start pulse of start signal GST2 may extend four clocks beyond start signal GST1, and clock signals CLK1, CLK2, CLK3, CLK4, CLK5, CLK6, CLK7, and CLK8 may be sequentially phased such that the operation of pixel rows 1-4 is sequential, followed by the sequential operation of rows 897-900 (e.g., the first four rows on the second side of the display), followed by the sequential operation of rows 5-8, and so forth until the end of the display frame with the operation of pixel row N. It should be appreciated that the last row operated in any display frame may be followed by a blanking period, if desired, before any of the operations described herein are repeated for a next display frame.

The enable signal SSM_En may be triggered to switch the display to a split-screen mode of operation or to a full-screen mode of operation responsive to a change in display content (e.g., a change to AR or VR content from video or still image content, or vice versa), responsive to a change in device orientation or position (e.g., based on a rotation of the device from a top-up orientation to a side-up orientation or based on a detection of proximity to a user's eyes or a VR or AR device), or responsive to a user request to switch modes (as examples).

Figure 15:
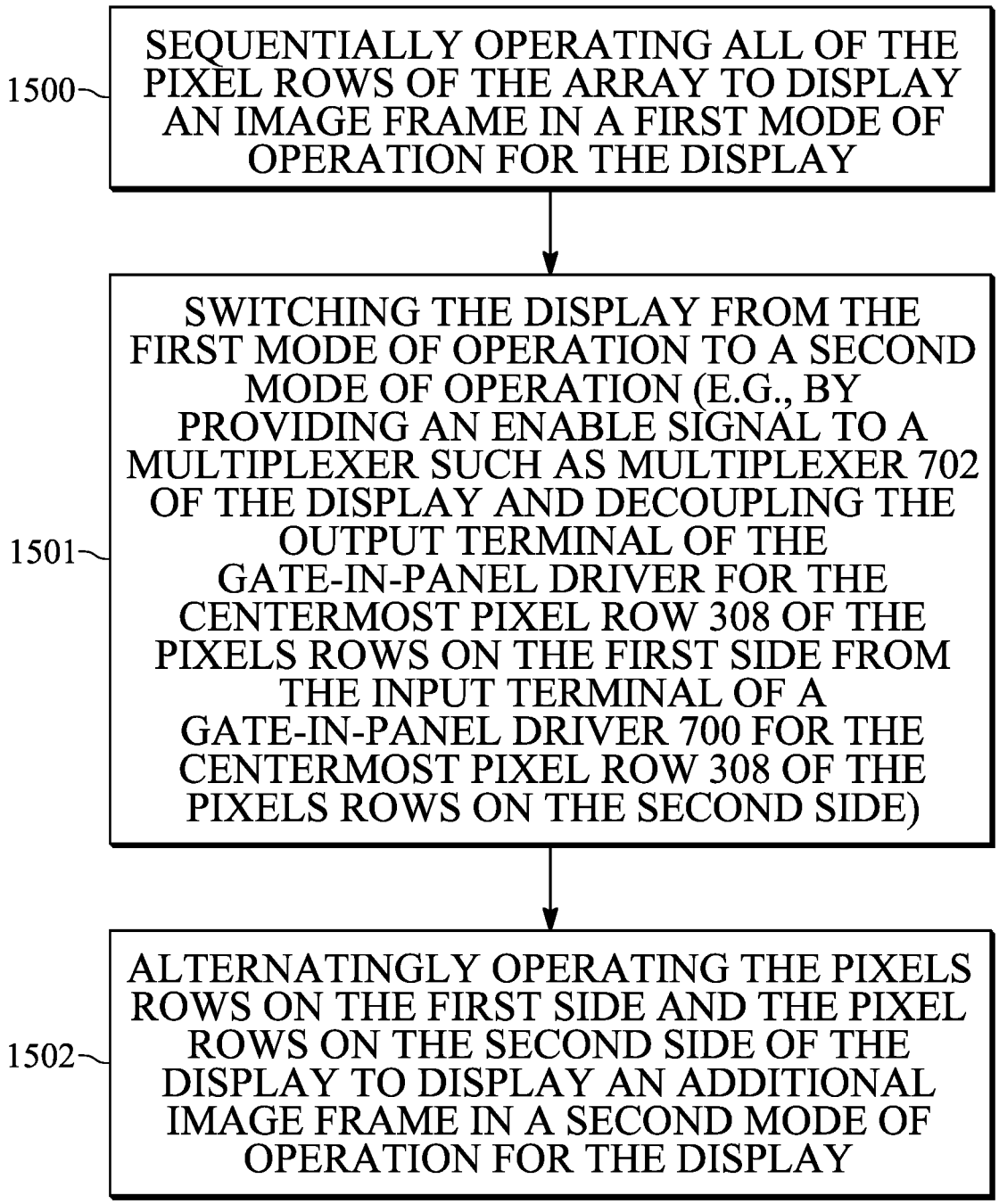
FIG. 15 illustrates a flow chart of an example process for operating an electronic device display in accordance with various aspects of the subject technology.

FIG. 15 depicts a flow diagram of an example process for operating a display for an electronic device in accordance with various aspects of the subject technology. For example, the display may include an array 200 of display pixels 206, the array including pixel rows 308 on a first side of a center 309 of the array and pixel rows 308 on a second side of the center 309 of the array. For explanatory purposes, the example process of FIG. 15 is described herein with reference to the components of FIGS. 1-9 and/or 13. Further for explanatory purposes, the blocks of the example process of FIG. 15 are described herein as occurring in series, or linearly. However, multiple blocks of the example process of FIG. 15 may occur in parallel. In addition, the blocks of the example process of FIG. 15 need not be performed in the order shown and/or one or more of the blocks of the example process of FIG. 15 need not be performed.

In the depicted example flow diagram, at block 1500, all of the pixel rows 308 of the array 200 are sequentially operated to display an image frame in a first mode of operation for the display. The first mode of operation may be a full-screen mode of operation.

At block 1501, the process may also include switching the display from the first mode of operation to a second mode of operation (e.g., by providing an enable signal to a multiplexer such as multiplexer 702 of the display). In the first mode of operation, an output terminal of a gate-in-panel driver 700 for a centermost pixel row (e.g., pixel row N/2) of the pixels rows on the first side is coupled, via the multiplexer 702, to an input terminal of a gate-in-panel driver 700 for a centermost pixel row (e.g., pixel row N/2+1) of the pixels rows on the second side. Switching the display from the first mode of operation to the second mode of operation may include, with the multiplexer and responsive to the enable signal, decoupling the output terminal of the gate-in-panel driver for the centermost pixel row 308 of the pixels rows on the first side from the input terminal of a gate-in-panel driver 700 for the centermost pixel row 308 of the pixels rows on the second side. Switching the display from the first mode of operation to the second mode of operation may also include, with the multiplexer 702 and responsive to the enable signal, coupling a start signal line such as start signal line 708 to the input terminal of a gate-in-panel driver 700 for the centermost pixel row 308 of the pixels rows on the second side.

At block 1502, the pixels rows on the first side and the pixel rows on the second side of the display are alternatingly operated (e.g., individually or in groups 1200) to display an additional image frame in a second mode of operation for the display. The second mode of operation may be a split-screen mode of operation. The split-screen mode of operation may be a virtual-reality mode of operation or an augmented-reality mode of operation.

In one example, alternatingly operating the pixels rows on the first side and the pixel rows on the second side of the display includes operating an outermost pixel row of the pixels rows on the first side, operating (immediately after the outermost pixel row of the pixels rows on the first side) a centermost pixel row of the pixels rows on the second side, and operating (immediately after the centermost pixel row of the pixels rows on the second side) a pixel row that is adjacent to the outermost pixel row of the pixels rows on the first side.

In another example, alternatingly operating the pixels rows on the first side and the pixel rows on the second side of the display includes operating an outermost pixel row of the pixels rows on the first side, operating (immediately after the outermost pixel row of the pixels rows on the first side) an outermost pixel row of the pixels rows on the second side, and operating (immediately after the outermost pixel row of the pixels rows on the second side) a pixel row that is adjacent to the outermost pixel row of the pixels rows on the first side.

In another example, alternatingly operating the pixels rows on the first side and the pixel rows on the second side of the display includes operating a centermost pixel row of the pixels rows on the first side, operating (immediately after the centermost pixel row of the pixels rows on the first side) a centermost pixel row of the pixels rows on the second side, and operating (immediately after the centermost pixel row of the pixels rows on the second side) a pixel row that is adjacent to the centermost pixel row of the pixels rows on the first side.

In another example, alternatingly operating the pixels rows on the first side and the pixel rows on the second side of the display includes operating an outermost group of the pixels rows on the first side, operating (immediately after the outermost group of the pixels rows on the first side) a centermost group of the pixels rows on the second side, and operating (immediately after the centermost group of the pixels rows on the second side) a group of pixel rows that is adjacent to the outermost group of the pixels rows on the first side. The outermost group of the pixels rows on the first side, the centermost group of the pixels rows on the second side, and the group of pixel rows that is adjacent to the outermost group of the pixels rows on the first side may each include two pixel rows, four pixel rows, eight pixel rows, or another number of pixel rows.

In accordance with various aspects of the subject disclosure, electronic device having a display is provided, the display including a display driver and a display panel. The display panel includes an array of display pixels arranged in pixel rows and pixel columns, a gate-in-panel driver for each pixel row, and a multiplexer coupled between an output terminal of a first one of the gate-in-panel drivers and an input terminal of a second one of the gate-in-panel drivers.

In accordance with other aspects of the subject disclosure, method of operating a display for an electronic device is provided. The display includes an array of display pixels, the array including pixel rows on a first side of a center of the array and pixel rows on a second side of the center of the array. The method includes sequentially operating all of the pixel rows of the array to display an image frame in a first mode of operation for the display. The method also includes alternatingly operating the pixels rows on the first side and the pixel rows on the second side of the display to display an additional image frame in a second mode of operation for the display.

In accordance with other aspects of the subject disclosure, an electronic device with a display is provided, the display including an array of display pixels including pixel rows on a first side of a center of the array, and pixel rows on a second side of the center of the array. The display further includes display control circuitry configured to sequentially operate all of the pixel rows of the array to display an image frame in a first mode of operation for the display. The display control circuitry is further configured to alternatingly operate the pixels rows on the first side and the pixel rows on the second side of the display to display an additional image frame in a second mode of operation for the display.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An electronic device having a display, the display comprising:

a display driver; and a display panel, the display panel comprising:

an array of display pixels arranged in pixel rows and pixel columns;

a gate-in-panel driver for each pixel row; and a multiplexer coupled between an output terminal of a first one of the gate-in-panel drivers and an input terminal of a second one of the gate-in-panel drivers, wherein the multiplexer comprises a selector pin configured to receive a signal that couples the output terminal of the first one of the gate-in-panel drivers to the input terminal of the second one of the gate-in-panel drivers for a full-screen mode of operation for the display and couples a start signal received by the multiplexer to the input terminal of the second one of the gate-in-panel drivers for a split-screen mode of operation for the display.

2. The electronic device of claim 1, wherein the multiplexer comprises a first input terminal coupled to the output terminal of the first one of the gate-in-panel drivers, a second input terminal configured to receive the start signal, and an output terminal coupled to the input terminal of the second one of the gate-in-panel drivers.

3. The electronic device of claim 2, wherein the multiplexer is configured to couple the first input terminal to the output terminal of the multiplexer for the full-screen mode of operation for the display and to couple the second input terminal to the output terminal of the multiplexer for the split-screen mode of operation for the display.

4. The electronic device of claim 3, wherein the split-screen mode of operation comprises an augmented-reality mode of operation or a virtual-reality mode of operation for the display.

5. The electronic device of claim 3, wherein:

a first half of the pixel rows is disposed on a top side of a horizontal centerline of the array of display pixels and includes a centermost pixel row adjacent to the horizontal centerline and coupled to the first one of the gate-in-panel drivers; and a second half of the pixel rows is disposed on a bottom side of the horizontal centerline and includes a centermost pixel row adjacent to the horizontal centerline and coupled to the second one of the gate-in-panel drivers.

6. The electronic device of claim 5, wherein a topmost pixel row of the first half of the pixel rows is coupled to a third one of the gate-in-panel drivers, and wherein the third one of the gate-in-panel drivers is configured to receive an additional start signal that is different from the start signal for the multiplexer.

7. The electronic device of claim 1, further comprising a select line coupled between the display driver and the selector pin of the multiplexer for enabling a split-screen mode of operation for the display.

8. The electronic device of claim 1, wherein the display driver is configured to sequentially operate all of the pixel rows of the array to display an image frame in the full-screen mode of operation for the display; and alternatingly operate the pixels rows on the first side and the pixels rows on the second side of the display to display an additional image frame in the split-screen mode of operation for the display, wherein alternatingly operating the pixels rows on the first side and the pixel rows on the second side of the display comprises:

operating an outermost pixel row of the pixels rows on the first side;

operating, immediately after the outermost pixel row of the pixels rows on the first side, an outermost pixel row of the pixels rows on the second side; and operating, immediately after the outermost pixel row of the pixels rows on the second side, a pixel row that is adjacent to the outermost pixel row of the pixels rows on the first side.

9. A method of operating a display for an electronic device, the display comprising an array of display pixels, the array including pixel rows on a first side of a center of the array and pixel rows on a second side of the center of the array, the method comprising:

sequentially operating all of the pixel rows of the array to display an image frame in a first mode of operation for the display; and alternatingly operating a single pixel row on the first side and a single pixel row on the second side of the display to display an additional image frame in a second mode of operation for the display, wherein the alternatingly operating the single pixel row on the first side and the single pixel row on the second side of the display comprises:

operating an outermost pixel row of the pixels rows on the first side;

operating, immediately after the outermost pixel row of the pixels rows on the first side, a centermost pixel row of the pixels rows on the second side; and operating, immediately after the centermost pixel row of the pixels rows on the second side, a pixel row that is adjacent to the outermost pixel row of the pixels rows on the first side.

10. The method of claim 9, wherein the first mode of operation is a full-screen mode of operation and the second mode of operation is a split-screen mode of operation.

11. The method of claim 10, wherein the split-screen mode of operation comprises a virtual-reality mode of operation or an augmented-reality mode of operation.

12. The method of claim 9, further comprising switching the display from the first mode of operation to the second mode of operation by providing an enable signal to a multiplexer of the display.

13. The method of claim 12, wherein, in the first mode of operation an output terminal of a gate-in-panel driver for a centermost pixel row of the pixels rows on the first side is coupled, via the multiplexer, to an input terminal of a gate-in-panel driver for a centermost pixel row of the pixels rows on the second side, and wherein switching the display from the first mode of operation to the second mode of operation comprises, with the multiplexer and responsive to the enable signal:

decoupling the output terminal of the gate-in-panel driver for the centermost pixel row of the pixels rows on the first side from the input terminal of a gate-in-panel driver for the centermost pixel row of the pixels rows on the second side.

14. The method of claim 13, wherein switching the display from the first mode of operation to the second mode of operation further comprises, with the multiplexer and responsive to the enable signal:

coupling a start signal line to the input terminal of a gate-in-panel driver for the centermost pixel row of the pixels rows on the second side.

15. An electronic device with a display, the display comprising:

an array of display pixels including:

pixel rows on a first side of a center of the array, and pixel rows on a second side of the center of the array; and display control circuitry configured to:

sequentially operate all of the pixel rows of the array to display an image frame in a first mode of operation for the display; and alternatingly operate the pixels rows on the first side and the pixels rows on the second side of the display to display an additional image frame in a second mode of operation for the display, wherein the display control circuitry comprises circuitry including a selector pin that is configured to receive a signal to selectively couple an input terminal of a second gate-in-panel driver for a centermost pixel row of the pixels rows on the second side to a start signal line in the second mode of operation for the display, wherein for the first mode of operation for the display, the selector pin is configured to receive the signal to selectively couple the output terminal of the first gate-in-panel driver to the input terminal of the second gate-in-panel driver.

16. The electronic device of claim 15, wherein the second mode of operation comprises an augmented-reality mode of operation or a virtual-reality mode of operation for the display.

17. The electronic device of claim 15, wherein the circuitry further comprises a multiplexer having the selector pin for switching the display to the second mode of operation or to the first mode of operation responsive to a change in display content, responsive to a change in device orientation or position, or responsive to a user request to switch modes.

18. The electronic device of claim 15, wherein alternatingly operating the pixels rows on the first side and the pixel rows on the second side of the display comprises:

operating a centermost pixel row of the pixels rows on the first side;

operating, immediately after the centermost pixel row of the pixels rows on the first side, a centermost pixel row of the pixels rows on the second side; and operating, immediately after the centermost pixel row of the pixels rows on the second side, a pixel row that is adjacent to the centermost pixel row of the pixels rows on the first side.

19. The electronic device of claim 15, wherein alternatingly operating the pixels rows on the first side and the pixel rows on the second side of the display comprises:

operating an outermost group of the pixels rows on the first side;

operating, immediately after the outermost group of the pixels rows on the first side, a centermost group of the pixels rows on the second side; and operating, immediately after the centermost group of the pixels rows on the second side, a group of pixel rows that is adjacent to the outermost group of the pixels rows on the first side.

20. The electronic device of claim 19, wherein the outermost group of the pixels rows on the first side, the centermost group of the pixels rows on the second side, and the group of pixel rows that is adjacent to the outermost group of the pixels rows on the first side each include four pixel rows.

* * * * *